United States Patent [19]

Ohira et al.

[11] 3,993,007

[45] Nov. 23, 1976

[54] STITCH FORMING MECHANISM OF A SEWING MACHINE

[75] Inventors: Atsuo Ohira, Toyota; Tatsuo Kozaki, Showa Chiryu, both of Japan

[73] Assignee: Aisin Seiki Kabushiki Kaisha, Japan

[22] Filed: Aug. 29, 1974

[21] Appl. No.: 501,613

[30] Foreign Application Priority Data

Aug. 31, 1973 Japan ..... 48-102983

[52] U.S. Cl. ..... 112/184

[51] Int. Cl.[2] ..... D05B 57/14

[58] Field of Search ..... 112/184, 181, 229, 231, 112/191

[56] References Cited

UNITED STATES PATENTS

| | | | |
|---|---|---|---|
| 785,168 | 3/1905 | Hemleb | 112/184 X |
| 1,931,456 | 10/1933 | Fleckenstein | 112/231 |
| 3,082,722 | 3/1963 | Tateishi | 112/181 |
| 3,693,565 | 9/1972 | Ketterer | 112/184 |

*Primary Examiner*—Werner H. Schroeder
*Assistant Examiner*—Peter Nerbun
*Attorney, Agent, or Firm*—Oblon, Fisher, Spivak, McClelland & Maier

[57] ABSTRACT

An improved lockstitching mechanism for a sewing machine wherein the cylindrical bobbin case having a bobbin therein for supplying a lower thread has an upper thread guide for slidably guiding a loop of the upper thread across the lower thread and a lower thread guide hole in the side wall below the upper guide for guiding the lower thread being extracted from the bobbin, whereby the lower thread is placed ahead of the needle relative to the rotational direction of the shuttle body supporting the bobbin, such that the upper thread only crosses the lower thread once during each stitching operation to prevent gnarling of the seam commonly referred to as "hitchstitching".

2 Claims, 7 Drawing Figures

STITCH FORMING MECHANISM OF A SEWING MACHINE

BACKGROUND OF THE INVENTION

1. Field of the Invention

This invention relates generally to a stitch forming mechanism of a sewing machine, and more particularly to an improved lockstitching mechanism having a single needle and maneuvering a pair of upper and lower threads in a manner to avoid hitchstitching.

2. Description of the Prior Art

In the conventional types of lockstitching mechanisms, there often appears a so-called hitchstitching, the operation of which will be explained in detail herein.

This hitchstitching makes a twisted and gnarled seam on the cloth, and accordingly, presents an unpleasant sight as seen from the outside thereof.

SUMMARY OF THE INVENTION

It is therefore an object of the present invention to provide an improved lockstitching mechanism for a sewing machine especially designed for completely obviating the occurrance of such undersired hitchstitching during the lockstitching operation.

The foregoing and other objects are attained in accordance with the present invention through the provision of a lockstitching mechanism for a sewing machine wherein the cylindrical bobbin case having a bobbin therein for supplying a lower thread has an upper thread guide for slidably guiding a loop of the upper thread across the lower thread and a lower thread guide hole in the side wall below the upper guide for guiding the lower thread being extracted from the bobbin, whereby the lower thread is placed ahead of the needle relative to the rotational direction of the shuttle body supporting the bobbin, such that the upper thread only crosses the lower thread once during each stitching operation to prevent gnarling of the seam commonly referred to as hitchstitching.

BRIEF DESCRIPTION OF THE DRAWINGS

Various other objects, features and attendant advantages of the present invention will be more fully appreciated as the same becomes better understood from the following detailed description when considered in connection with the accompanying drawings wherein like reference numerals designate like or corresponding parts throughout the several views, and in which.

DETAILED DESCRIPTION OF THE PREFERRED EMBODIMENTS

Figure 1A:
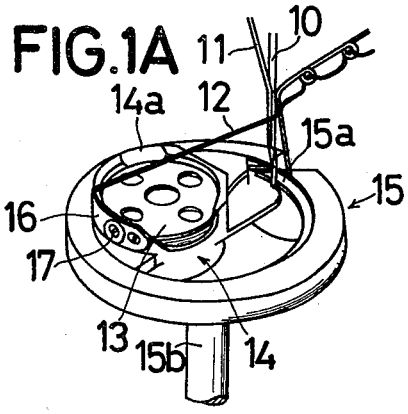
FIGS. 1A through 1C are perspective views showing the steps of lockstitching operation during which the undesired hitchstitching occurs in the conventional type lockstitching mechanisms.
Figure 1B:
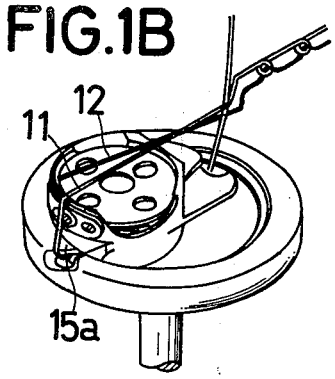
Figure 1C:
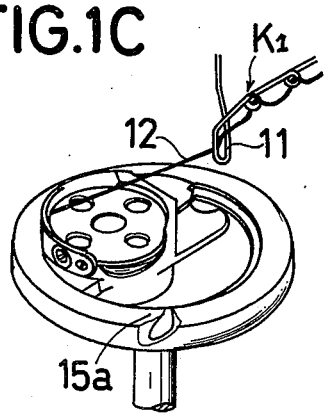

Referring now to the accompanying drawings, and more particularly to FIGS. 1A, 1B and 1C, the numeral 10 designates a needle attached to a needle bar, not shown, being vertically reciprocable by actuation of a conventional thread take up lever means, also not shown. An upper thread 11 is inserted into a needle hole of the needle 10 and is movable therewith, while a lower thread 12 is wound ground a bobbin 13 which is disposed within a cylindrical bobbin case 14, and one end of the lower thread 12 is tensionally extractable from the bobbin 13 for preparing a stitch operation.

The bobbin case 14 has at its upper brim portion an upper thread guide **14*a* for slidingly and smoothly guiding the upper thread 11** and enlarging a loop thereof.

A circular shuttle body 15 is rotatable within a horizontal plane by actuation of a shuttle shaft, not shown. The shuttle body 15 has a hook portion **15*a* provided at an outer peripheral portion thereof and an axle portion 15*b* operatively connected with the shuttle shaft through a gear mechanism, not shown. The tension of the lower thread 12 is regulated by a thread tension spring 16 through an adjustable screw bolt 17**.

A recessed portion **14*c* of the bobbin case 14, through which the lower thread 12 is supplied from the bobbin 13, is provided between the bobbin 13 and the thread tension spring 16**.

The manner in which hitchstitching occurs in using the conventional type lockstitching mechanism will now be explained. First, a loop of the upper thread 11 is formed by a downward movement of the needle 10, the lowermost end thereof thus being positioned at the left side with respect to the extracted lower thread end, as seen in FIG. 1A. Next, the loop of the upper thread 11 is caught in the hook portion **15*a* of the shuttle body 15 by an initial counterclockwise rotation thereof and the loop is then enlarged by further rotation of the shuttle body 15. Thus, the loop is slidably moved along the upper thread guide 14*a* of the bobbin case 14 to cross over the lower thread 12, thereby enveloping the lower thread 12 from the upper and lower sides thereof with the enlarged loop of the upper thread 11. Stated in other words, the upper thread 11 crosses the lower thread 12 twice during each stitching operation. Lastly, the loop of the upper thread is released from the hook portion 15*a* by upward movement of the needle 10, whereby the gnarled seam $K_1$ is formed, as shown in FIG. 1C**.

Figure 2A:
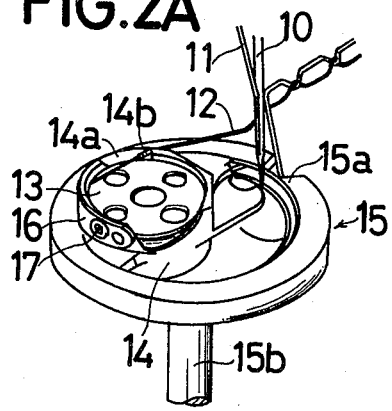
FIGS. 2A through 2C are perspective views showing the steps of a normal lockstitching operation according to one embodiment of the present invention.
Figure 3:
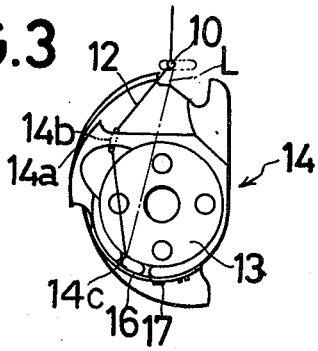
FIG. 3 is a front view of FIG. 2A showing the main structural arrangement of the mechanism of the present invention.

In comparison with this hitchstitching formation occurring in the operation of the conventional type lockstitching mechanisms, according to the present invention, there is provided a lower thread guide hole **14*b* in the bobbin case 14 for guiding the extracted lower thread 12 from the bobbin 13, as shown in FIG. 2A, so that the normal lockstitching operation may be performed. The lower thread guide hole 14*b* of the bobbin case 14 is, to be exact, provided in the left side wall of the bobbin case 14, with respect to the line L, shown in FIG. 3, connecting the lowermost end of the needle 10 with a recessed portion 14*c* of the bobbin case 14 when the shuttle body 15 is supposed to be rotated in the counterclockwise direction, as seen in FIG. 3. Accordingly, when the needle 10 reaches its lowermost position in its downward movement, it is always positioned at the right side relative to the lower thread 12, since the lower thread 12** is always forced to be separated from the line L.

Figure 2B:
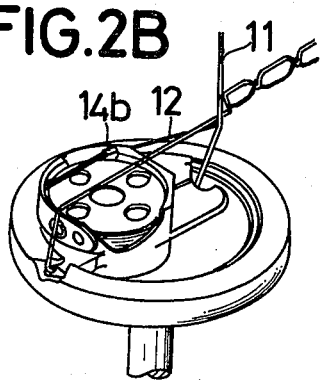

In this way, the needle 10, and accordingly, the upper thread 11, is positioned to the right of the lower thread 12, as is shown in FIG. 2A, and this will cause the upper thread 11 to cross over the lower thread 12 only once during each stitching operation, as shown in FIG. 2B.

Figure 2C:
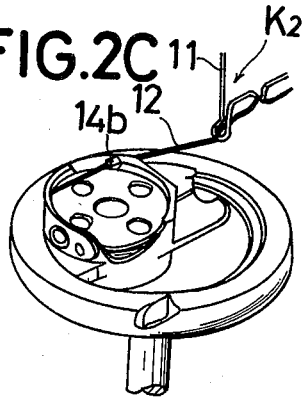

Thus, the seam $K_2$, shown in FIG. 2C, formed according to the operation of the mechanism of this invention, has no gnarled seams therein, even when the stitching operation is continuously performed.

Obviously, numerous modifications and variations of the present invention are possible in light of these teachings. It is therefore to be understood that within the scope of the appended claims, the invention may be practiced otherwise than as specifically described herein.

What is claimed as new and desired to be secured by Letters Patent of the United States is:

1. A stitch forming mechanism for use in a sewing machine, comprising:

a needle vertically reciprocable by actuation of a thread take-up means;

a pair of upper and lower threads for forming a seam on a cloth by crossing each other;

a shuttle body rotatable in a horizontal plane by actuation of a supporting shuttle shaft and having a hook for engaging a loop of the upper thread; and a cylindrical bobbin case disposed in said shuttle body and having a bobbin therein for supplying the lower thread therefrom, an upper thread guide portion being provided on said bobbin case for slidably guiding the loop of the upper thread for crossing the same over the lower thread, a recessed portion being defined within said bobbin case so as to facilitate supply and withdrawal of said lower thread from said bobbin to said needle, and a lower thread guide hole being formed in the side wall of said bobbin case below said upper thread guide portion and interposed between said recessed portion and said needle for guiding the lower thread withdrawn from the bobbin so as to place the lower thread ahead of the needle with respect to the rotational direction of the shuttle body.

2. A stitch forming mechanism according to claim 1, wherein said upper thread guide portion of said bobbin case is provided in an upper brim portion thereof.

* * * * *